US006374901B1

(12) United States Patent
Frank et al.

(10) Patent No.: US 6,374,901 B1
(45) Date of Patent: Apr. 23, 2002

(54) DIFFERENTIAL QUENCH METHOD AND APPARATUS

(75) Inventors: William R. Frank, Bettendorf; Jonathan Dorricott, Davenport, both of IA (US); Laurie E. Collins, Regina (CA); Joseph D. Russo; Robert J. Boecker, both of Bettendorf, IA (US); Brian H. Wales, Davenport, IA (US)

(73) Assignee: IPSCO Enterprises Inc.

( * ) Notice: Subject to any disclaimer, the term of this patent is extended or adjusted under 35 U.S.C. 154(b) by 0 days.

(21) Appl. No.: 09/350,319

(22) Filed: Jul. 9, 1999

Related U.S. Application Data

(63) Continuation-in-part of application No. 09/113,428, filed on Jul. 10, 1998, now abandoned.

(51) Int. Cl.[7] ..... B22D 11/16
(52) U.S. Cl. ..... 164/414; 164/444; 164/154.1
(58) Field of Search ..... 164/455, 454, 164/486, 414, 444, 154.1

(56) References Cited

U.S. PATENT DOCUMENTS 3,468,362 A * 9/1969 Burkhardt et al. ..... 164/444
3,877,510 A 4/1975 Tegtmeier et al.
3,885,741 A 5/1975 Wagener et al.
3,897,906 A 8/1975 Bachner
3,915,216 A * 10/1975 Fekete et al. ..... 164/455
3,935,896 A 2/1976 Tegtmeier et al.
3,941,611 A 3/1976 Greenberger
3,946,792 A 3/1976 Thalmann
3,981,347 A 9/1976 Willim
3,989,093 A 11/1976 Peitl et al.
4,006,633 A 2/1977 Shipman et al.
4,009,750 A 3/1977 Fekete et al.
4,031,946 A 6/1977 Marti et al.
4,043,384 A 8/1977 Piepenhagen et al.
4,047,985 A 9/1977 Greenberger
4,073,332 A 2/1978 Etienne
4,169,498 A 10/1979 Wilhelm
4,235,276 A 11/1980 Gilles et al.
4,250,951 A 2/1981 Mezger et al.
4,256,168 A 3/1981 Hein et al.
4,285,388 A 8/1981 Sevastakis
4,371,149 A 2/1983 Takeuchi et al.
4,422,303 A 12/1983 Rothenberg et al.
4,424,855 A 1/1984 Tsubakihara et al.
4,440,583 A 4/1984 Ikegami et al.
4,440,584 A 4/1984 Takeshige et al.
4,463,795 A 8/1984 Chielens et al.
4,473,106 A 9/1984 Sautebin
4,476,914 A 10/1984 Wrossok
4,483,387 A 11/1984 Chielens et al.
4,508,160 A 4/1985 Sautebin
4,562,880 A 1/1986 Larrecq et al.
4,567,934 A 2/1986 Nakao et al.
4,572,280 A 2/1986 Haller
4,592,510 A 6/1986 Grothe
4,658,882 A * 4/1987 Oba et al. ..... 164/417
4,699,202 A 10/1987 Gilles
4,705,096 A 11/1987 Chia
4,723,562 A 2/1988 Wilmotte et al.
4,765,390 A 8/1988 Vaterlaus
4,901,785 A 2/1990 Dykes et al.

(List continued on next page.)

*Primary Examiner*—Nam Nguyen
*Assistant Examiner*—Ing-Hour Lin
(74) *Attorney, Agent, or Firm*—Robert H. Barrigar

(57) ABSTRACT

Surface defects in rolled steel are remedied by quenching a surface layer of the strand immediately downstream of the caster by transversely differential quenching to match the transverse temperature profile of the strand. The flow rate of the quench spray is differentially adjustable across the width and optionally the length of the strand. An array of spray nozzles controlled by groups provides the quench spray.

9 Claims, 6 Drawing Sheets

U.S. PATENT DOCUMENTS 4,934,445 A 6/1990 Plata et al.
4,951,734 A * 8/1990 Hoffken et al. ..... 164/455
4,987,950 A 1/1991 Yu
5,063,991 A 11/1991 Bobadilla et al.
5,085,264 A 2/1992 Jolivet et al.
5,112,412 A 5/1992 Plata et al.
5,119,883 A 6/1992 Wagstaff et al.
5,148,853 A 9/1992 Yu et al.
5,201,363 A 4/1993 Demarez et al.
5,284,327 A 2/1994 Arthur et al.
5,289,867 A 3/1994 Barker et al.
5,382,306 A 1/1995 Plata et al.
5,413,314 A 5/1995 Plata et al.
5,499,523 A 3/1996 Ginzburg
5,634,512 A 6/1997 Bombardelli et al.
5,665,181 A * 9/1997 Rohde ..... 148/541
5,915,457 A * 6/1999 Pleschiutschnigg ..... 164/476

* cited by examiner

DIFFERENTIAL QUENCH METHOD AND APPARATUS

RELATED APPLICATION

This application is a continuation-in-part of U.S. application Ser. No. 09/113,428 filed Jul. 10, 1998 and now abandoned.

FIELD OF THE INVENTION

The present invention comprises methods of and apparatus for quenching a continuously cast steel product upstream of a reheat furnace that brings the steel to a uniform initial rolling temperature. One purpose served by the invention is to eliminate or reduce the incidence and severity of surface defects in the steel that occur during reduction rolling. There are a number of inventive aspects of the applicant's methods and apparatus that collectively may comprise more than one invention, but for convenience, reference will be made to "the invention" on the understanding that the term covers the collectivity of inventions claimed herein.

BACKGROUND OF THE INVENTION

In conventional continuous casting mills with direct hot charging, steel in a caster assembly is cast into a continuous strand, and passes through a strand containment apparatus in which the steel surface is cooled and the strand changes direction from the vertical to the horizontal. The strand is then conveyed to a severing apparatus where it is severed into slabs, blooms, billets or other products. The slab or other product then enters a reheat furnace for heating to a uniform temperature suitable for downstream rolling and other processing.

Problems encountered with plate steel product produced by such continuous casting mills include the tendency for areas around one or more surfaces of the steel product to exhibit brittleness, cracking, sponging, and other surface defects (hereinafter collectively referred to as "surface defects" for convenience). Surface defects are especially prevalent after the interim steel product is subjected to downstream rolling or other stresses. Although the causes of such surface defects are not completely understood, it has been observed that surface defects tend to occur frequently in steel products having surfaces that are at or above the steel's austenite-to-ferrite transformation start temperature ($Ar_3$) when the product exits the caster assembly, cool to a temperature above the steel's austenite-to-ferrite transformation completion temperature ($Ar_1$) as the product enters the reheat furnace, then are reheated to a temperature above the transformation start temperature when the product is inside the reheat furnace. Steel products that tend to be particularly susceptible to surface defects include low- to high-carbon steels and low-alloy steels, all of which may contain aluminum (Al) and residual elements such as sulphur (S), phosphorus (P), nitrogen (N), and copper (Cu).

While an understanding of the causes of the surface defects is not per se necessary for the practice of the invention, some discussion of the applicant's understanding of the phenomenon may be helpful to the reader. Steel product exiting the caster assembly has a coarse austenite grain structure. As the steel product cools to a temperature above the transformation completion temperature $Ar_1$ of the metal, various elements including residual elements migrate to the austenite grain boundaries where they will reside as solute elements, or eventually combine to form precipitates. If the steel product has not cooled to below the transformation completion temperature $Ar_1$ before reheating in the reheat furnace, these elements, in either solute or precipitate form, remain at or near the original austenite grain boundaries. The presence of these elements on grain boundaries and/or the development of precipitate-free zones adjacent to grain boundaries can be detrimental to the ductility of the steel product and may also contribute to the manifestation of one or more types of surface defects. It appear that the principal culprit in many cases is the copper present.

If the interim steel product is taken off-line and left for several hours to cool slowly in still air, the entire product will have completely transformed from coarse-grained austenite to other microconstituents, such as ferrite or pearlite. Reheating this product in a reheat furnace to above the $Ac_3$, (about 900 C. for most steels of interest) the critical temperature above which there is austenite recrystallization, re-transforms the product into fine-grained austenite. It has been found that a product having such a fine-grained austenitic microstructure tends to be free from surface defects. However, such slow cooling requires the product to be taken off-line for an undesirably lengthy period of time, thereby slowing down steel production.

It has been found that instead of re-transforming the entire steel product into fine-grained austenite, it is necessary to re-transform only the surface layers to a suitable depth to achieve a product that is for the most part free of surface defects. However, off-line slow air cooling to achieve a re-transformed layer of sufficient depth requires an undesirably lengthy time.

Previously known methods have been devised in which a slab is taken off-line, immersion-quenched in a quench tank, then returned on-line for transfer into the reheat furnace. In such methods, the temperature of the slab surfaces is often reduced below the $Ar_1$, i.e. the steel's transformation completion temperature, before the slab is reheated in the reheat furnace. It has been found that an immersion-quenched slab tends to exhibit undesirably inconsistent metallurgical properties along its length. This inconsistency appears to be due to the formation of a lengthwise temperature gradient on the slab prior to its immersion; since the slab is cast from a continuous caster, its downstream portions have had more time to cool than its upstream portions.

In another known method, the casting is spray-quenched prior to severing into slabs and prior to entering the reheat furnace. An example of such a method is described in U.S. Pat. No. 5,634,512 (Bombardelli et al.). According to Bombardelli, quenching the strand is accomplished by a quench apparatus that sprays water under pressure through a plurality of sprayer nozzles onto the surfaces of the strand so that the surfaces are rapidly cooled.

A problem associated with Bombardelli's teaching is that the quench apparatus tends to create a transformed surface layer having an inconsistent depth and microstructure in steel products that, because of casting line speed variations, have developed irregular transverse and longitudinal temperature profiles along their surfaces prior to entering into the quench apparatus. Because the spray intensity in the Bombardelli apparatus cannot be varied amongst nozzles in a group of nozzles directed at a product surface, a product surface having a non-uniform pre-quench temperature profile will have a non-uniform post-quench temperature profile after being sprayed by the Bombardelli quench apparatus, thereby causing inconsistent surface layer properties, including inconsistent microstructures at any given depth of the surface layer.

SUMMARY OF THE INVENTION

The invention comprises a method and apparatus for in-line quenching a steel product. In line in such facility would conventionally be found, in downstream progression: (1) a caster mould and a strand containment and straightening apparatus, all within a caster assembly; (2) a severing apparatus for severing the steel product from a strand into slabs or other products; and (3) a reheat furnace for reheating the steel product after it has been severed. The steel is normally conveyed from the caster to the reheat furnace on a plurality of spaced conveyor rolls (table rolls).

According to the invention, quenching is effected by applying a plurality of controlled pressurized sprays of cooling fluids (preferably air-mist) to selected portions of one or more surfaces of the steel product exiting the caster, so as to effect in a surface layer of the steel casting a metallurgical change from the initial austenite to desired microconstituents such as ferrite or pearlite. The quench effects this change to a desired depth of penetration from the surface of the steel prior to the entry of the steel into the reheat furnace. In the reheat furnace, each quenched surface layer is reheated to a temperature above the $Ac_3$ and retransformed to finer grains of austenite, thereby reducing the occurrence of surface defects on the eventual steel plate product. In practice, the product is also heated above $T_{nr}$ to provide a suitable temperature for downstream controlled rolling.

Further, the sprays are arranged into one or more arrays. The sprays in each array are arranged into spray groups, wherein each spray group comprises one or more sprays. The intensity of the sprays in each spray group is controllable separately from the intensities of sprays in other spray groups. Each spray group may conveniently comprise one or more longitudinally aligned banks of nozzles, each bank comprising a series of nozzles extending parallel to the direction of the casting line. Optionally, other nozzle groups may comprise transversely aligned rows of nozzles extending perpendicular to the direction of the casting line. Preferably one array of nozzles is positioned above the steel and another counterpart array underneath the steel, so that upper and lower surfaces of the steel may be quenched in a balanced, uniform manner.

The steel is conveyed from the caster along the line by the rolls and passes between the top and bottom arrays of sprays. The flow rate of cooling fluid applied by each spray group is separately controlled. To the extent reasonably possible, the flow rates of the spray groups are adjusted so that all surfaces of the steel will be quenched to the same uniform surface temperature after the steel exits the quench.

The flow rates of cooling fluid applied by the spray groups are differentially selected in a transverse sense (i.e. perpendicular to the casting line direction), because the steel typically experiences non-uniform transverse cooling. In some situations, differential selection of flow rates of other spray groups in a longitudinal sense may also be useful.

In the present specification, castings severed into slabs will be discussed by way of example, it being understood that the discussion will also apply, mutatis mutandis, to other castings. In slabs, the surface portions nearer the slab's edges tend to cool more quickly than the inner (central) surface portions; therefore, the edges will be cooler than the central surface portions when the steel reaches the quench sprays. Accordingly, the spray flow rate per surface area provided by the transversely outermost spray groups will be selected to be less than that provided by the spray groups that spray the inner surface portions of the steel, in order to quench all the surface portions to the same post-quench temperature, within engineering limits.

Also, due to anomalies in orderly progress of the steel through the caster or downstream thereof, the steel sometimes cools unequally in a longitudinal direction, so that downstream surface portions are at a different temperature at a given line location then upstream surface portions when they reach the same location. To quench the steel so that all of its surface is quenched to substantially the same temperature and same depth, the spray intensity may be varied with line speed so that each surface portion of the steel is quenched to substantially the same post-quench temperature and to substantially the same depth. Note that such selection or adjustment may be partly space-sensitive and partly time-sensitive; if longitudinally adjustable spray groups are provided, at least some adjustment may be selected by varying the flow rates through such groups or selectively turning selected ones of such groups off or on. If such longitudinally adjustable spray groups are not provided, then longitudinal adjustment of quench spray must be effected by varying over time the flow rates in the available spray groups. Differential longitudinal control of spray is discussed further below.

According to another aspect of the invention, the appropriate selection of flow rate for each spray group is determined by a control unit. The control unit, which may include a general-purpose digital computer or a special-purpose microcontroller, has a plurality of input terminals for receiving data signals from a plurality of input devices, and a plurality of output terminals of controlling a plurality of output devices that collectively serve to control the flow rate and optionally other spray characteristics (e.g., pressure, nozzle spray pattern, if controllable) of each spray group. The input devices may include, for example, a plurality of temperature sensors disposed upstream and downstream of the quench apparatus for measuring the temperature of selected surface portions of the steel entering and exiting the quench apparatus respectively, a casting width setting, and a rotational speed sensor associated with the conveyor rolls for measuring the speed of the steel passing through the quench apparatus.

The control unit processes the data signals received from the speed and temperature sensors and any other input devices, and then, using empirically derived cooling history data for the type of steel being cast, selects the spray groups that will be operable above minimum flow rate, and calculates for each of those selected groups the preferred flow rate, pressure and any other controlled spray characteristics. Then, the control unit sends control signals to the output devices (including, for example, flow rate control valves and pressure regulators downstream of pumps and compressors), so that the flow rate and any other controlled parameters such as spray intensity are set for each group of nozzles. If the quench apparatus is quenching severed strand segments such as slabs, the control unit may also send control signals to one or more conveyor roll drive units to adjust the speed of the rolls, and thus, the speed of the slab passing through the quench apparatus. The foregoing series of operations are continued on a cycling basis by the computer or microprocessor; input values are constantly monitored and as changes occur, output values are modified accordingly.

While a control unit of the foregoing type may advantageously operate mostly or wholly automatically, the system can be designed so that an operator, by using a manual input device communicative with the quench apparatus, may input data or may manually control the quench apparatus. Thus, the operator may operate the quench apparatus under the control of the control unit, or may instead override certain aspects of the control unit's operation.

Various methods of controlling the rate of discharge of cooling fluid from the various groups of nozzles can be devised. Individual nozzles may be provided with individually controllable valves, or a bank or group of nozzles may be controlled from a single valve. The valve may be a simple off/on valve, or may be adjustable flow-rate valve, or some combination of the foregoing alternatives may be provided.

One optional transverse flow-control technique proceeds on the premise that the surface temperatures profile from one edge of the casting to the longitudinal centre of the casting will gradually increase, and then will gradually drop off to the other edge of the casting; the temperature profile about the longitudinal center line of the casting is generally symmetrical. This symmetry enables flow control valves to be grouped in longitudinally aligned banks, with banks equidistant from the longitudinal center controlled by the same valve. On each side of the longitudinal center line, more than one longitudinal bank of nozzles may be grouped together to form, with its mirror image on the other side of the center line, a single group. In such arrangements, each group of nozzles may be controlled as a unit by means of a single valve, or alternatively the flow rate for any given group may be set to be some constant fraction of the maximum flow rate delivered to the central group of nozzles. (The maximum flow rate would normally be expected to be delivered to the central group because the transverse temperature profile reaches a maximum there.)

It is possible, instead of or in addition to varying the flow rate for a given longitudinal bank of nozzles at any given transverse distance from the center line of the casting, to selectively idle those banks of nozzles that are more remote from the center line, where reduced cooling is required in the vicinity of the transverse extremities of the casting. In the simplest case, given that the entire nozzle array will be designed to accommodate castings of maximum width, the outermost banks of nozzles can be idled whenever the casting being produced is less than maximum width. However, it may be desirable not only to idle those banks of nozzles that are offset outwardly from the transverse edges of the casting, but also those banks that overlap the side edges of the casting. The reason is that the side edges tend to cool more quickly than the central portions of the casting, and also surplus cooling fluid tends to migrate toward the side edges, so idling nozzles that overlap the casting edges may give optimum results.

Note that for all or most banks of nozzles, "idling" involves continuing at least some minimal flow of fluid through the nozzles in order that the nozzles are not damaged by the heat from the casting. In order to save water, and to avoid excessive cooling of the casting, such idling groups of nozzles may be operated on a pulsed basis, so that they pass no fluid for a period of time, and then pass a minimal heat-damage-avoiding amount of fluid for a second period of time, cycling between the two modes.

It may also be desirable to set the flow rate for the nozzles at the input end of the quench unit at a higher level than nozzles downstream, in order to impart a rapid initial surface quench to the steel. This setting, if this option is selected, may be fixed or variable, and would normally be independent of the longitudinal spray control adjustment to compensate for variations in casting speed, discussed next. In certain circumstances and especially with respect to quenching crack-sensitive materials (such as high carbon steel, or high carbon low alloy steels), the flow rate may be set lower at the input end and higher at the output end to avoid initiating the formation of cracks caused by the shock of the quench, or aggravating any cracks that may have formed in the caster assembly 21.

As mentioned, it may be desirable to provide some degree of adjustment of fluid flow from the nozzles in response to changing line speed (i.e. in response to the changing speed of the casting in a longitudinal direction). Such speed changes arise from both normal and anomalous conditions; while complete stops of the casting line are rare except at the end of a casting run, it is not unusual for casting speeds in state-of-the-art steel mills to range from a minimum of about 5 inches per minute to more than 50 inches per minute.

Note that the transversely variable flow control system previously described results in fine control only within the limits available in a configuration in which the nozzles are grouped as selections of longitudinally aligned banks of nozzles. It is contemplated that each longitudinal bank would occupy most of the longitudinal space available to such bank within the group chamber. The foregoing, therefore, does not take into account the possibility that the designer might wish to regulate flow rate longitudinally on a fine-control basis from the upstream inlet port of the quench unit to the downstream outlet port of the quench unit for the reasons described previously. Such fine control of the quench spray over a longitudinal interval of the casting line is difficult to implement using only longitudinally aligned banks of nozzles—such groups would have to be split up into sub-groups in a longitudinal series, or in the limiting case, controlling each nozzle by a discrete valve.

An alternative design approach, if such longitudinal variation in nozzle spray is desired, is to establish a second array of nozzles interspersed with the transversely controlled nozzle array, into second array being actuated on a longitudinally adjustable basis instead of a transversely adjustable basis. To this end, for convenience of installation, the second longitudinally adjustable nozzle array could comprise separate longitudinally-spaced rows or banks of transversely aligned nozzles, and could be provided with supply pipes for the nozzles that extend vertically a greater distance than the supply pipes for the transversely adjustable nozzles, thereby facilitating the provision of different sets of horizontally oriented supply conduits for the transversely variable nozzle array from those for the longitudinally variable nozzle array, the two sets of supply conduits being perpendicular to one another. An individually adjustable valve could be provided for each such transversely extending bank of nozzles; again variable control or simple on/off control for each such bank could be provided. If some transverse temperature profile is desired for the spray to be applied to the longitudinally variable nozzle arrays, yet fine control is sought to be avoided as unduly complex or expensive, the nozzle size could vary over the transverse span of each row of such nozzles, with the nozzles overlying the central inner areas of the surface of the steel providing more flow of cooling fluid than those nozzles overlying the outer surface areas of the steel.

In considering the effect of changing casting speed upon the quench arrangement, account must be taken of the fact that problems arising from abrupt cooling of the casting caused by sudden deceleration of the casting line speed usually require a more rapid response than problems associated with casting line speed increase. Accordingly, the flow rate of fluid through the nozzles should decrease appreciably if there is a significant deceleration in casting line speed. By contrast, acceleration of casting line speed may require a more modest response by the flow-control system; an increase in flow rate of less than half the decrease associated with a line speed deceleration may be adequate. Severe over-quenching tends to be more of a potential problem than under-quenching; temperature feedback control from a pyrometer or other temperature monitoring device upstream and downstream of the quench facilitates avoidance of over-quenching. Severe over-quenching can cause severe distortions in the steel, and even cracking or breaking of some grades of steel. Such over-quenching is of particular concern with crack-sensitive materials.

Note that because of the need to provide at least some minimum rate of flow through the nozzles to prevent damage to the nozzles, fine control over quench flow-rates for very slow-moving castings may be difficult or impossible to achieve. In practice, this tends not to present a problem for mild over-quenching of the casting—mild over-quenching has the negative consequence that more heat is required in the reheat furnace to bring the casting up to the initial rolling temperature, but otherwise there is not significant, if any, metallurgical damage to the surface of the casting by quenching to a somewhat deeper layer than is considered optimal. Nevertheless, severe over-quenching is to be avoided for the reasons already mentioned.

The choices of nozzle banks to be controlled together, of nozzle spacing and sizing and maximum flow rate, of minimum flow rate and whether idling nozzles should be pulsed or run continuously at minimum flow rate, of flow rate for specified casting speeds, of the nozzle banks chosen to be active for a casting of a specified width, of the acceleration and deceleration of flow rate in response to acceleration and deceleration of casting line speed, and similar such design choices, may be made empirically on the basis of trial runs. If surface cracks are not occurring in the finished product, the choices made will generally prove to have been sound from a metallurgical standpoint. It remains to provide for reasons of economy the minimum quenching compatible with a good metallurgical result, because too much quenching costs money; more heat is required in the reheat furnace to bring an over-quenching casting up to uniform target pre-rolling temperature.

For a given nozzle array, the designer has to select the number of nozzles to be provided for the quench apparatus, their spacing from one another, the number of banks of nozzles to be under the control of a single valve (or operating in response to a single control signal), maximum and minimum flow rates per nozzle, the ratio of casting speed to nozzle flow rate in a given active bank, the ratio of flow rates in the outer banks of nozzles relative to the flow rates provided for the central bank, etc. For optimal results, any such design should be tested on an empirical basis.

Whether a steel product has been satisfactorily quenched is typically determined empirically; to this end, a quenched test portion of the steel may be removed from the line downstream of the reheat furnace. The cross-section of the test portion is then examined to determine whether the flow provided by each spray group has been appropriately selected or adjusted by the control unit. For a given slab, the steel layers adjacent to the top and bottom surfaces are examined to determine whether the quench has suitably transformed the steel's microstructure, and whether the depth of transformation is satisfactory. A series of such measurements and observations can be used to calibrate the control unit and the operating mechanisms that adjust selected controlled spray parameters.

Occasionally there is a line interruption of sufficient duration that the quench should be discontinued. In such situations, the use of the present invention may be insufficient to prevent surface defects; the steel may have to be downgraded or conceivably even scrapped. In such cases, the flow through the spray nozzles is reduced but not completely interrupted, so that the continuous flow of fluid through the nozzles cools the nozzles sufficiently to prevent damage to the nozzles. Note that below some minimum flow rate per nozzle, the nozzle spray pattern may become restricted or irregular, causing non-uniformity of surface quench. The system should be designed to avoid normal operation below such minimum flow rate.

DETAILED DESCRIPTION

Figure 1:
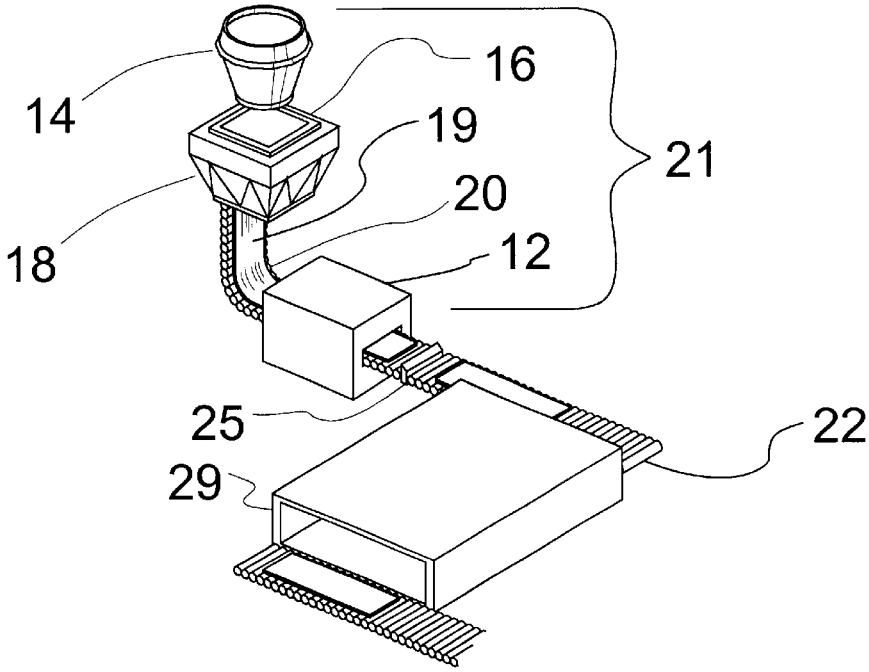
FIG. 1 is schematic perspective view of a portion of a continuous casting line in which a quench apparatus according to the invention is installed.

A portion of a casting line of a continuous casting steel facility in which a quench apparatus 12 according to the invention is installed, is schematically illustrated in FIG. 1. Typically, molten steel is poured from a ladle 14 into a tundish 16 that acts as a temporary reservoir. The molten steel is poured from tundish 16 into a mould 18, which is water cooled so that the surface of the steel passing through the mould 18 solidifies to form a continuous thin-skinned strand 19. The strand 19 exits the mould 18 and enters a strand containment and straightening apparatus 20 in which it continues to solidify as it continues to cool, moves arcuately from a generally vertical orientation to a generally horizontal orientation, and is straightened in its horizontal orientation. The devices just described collectively constitute a caster assembly 21.

Figure 2:
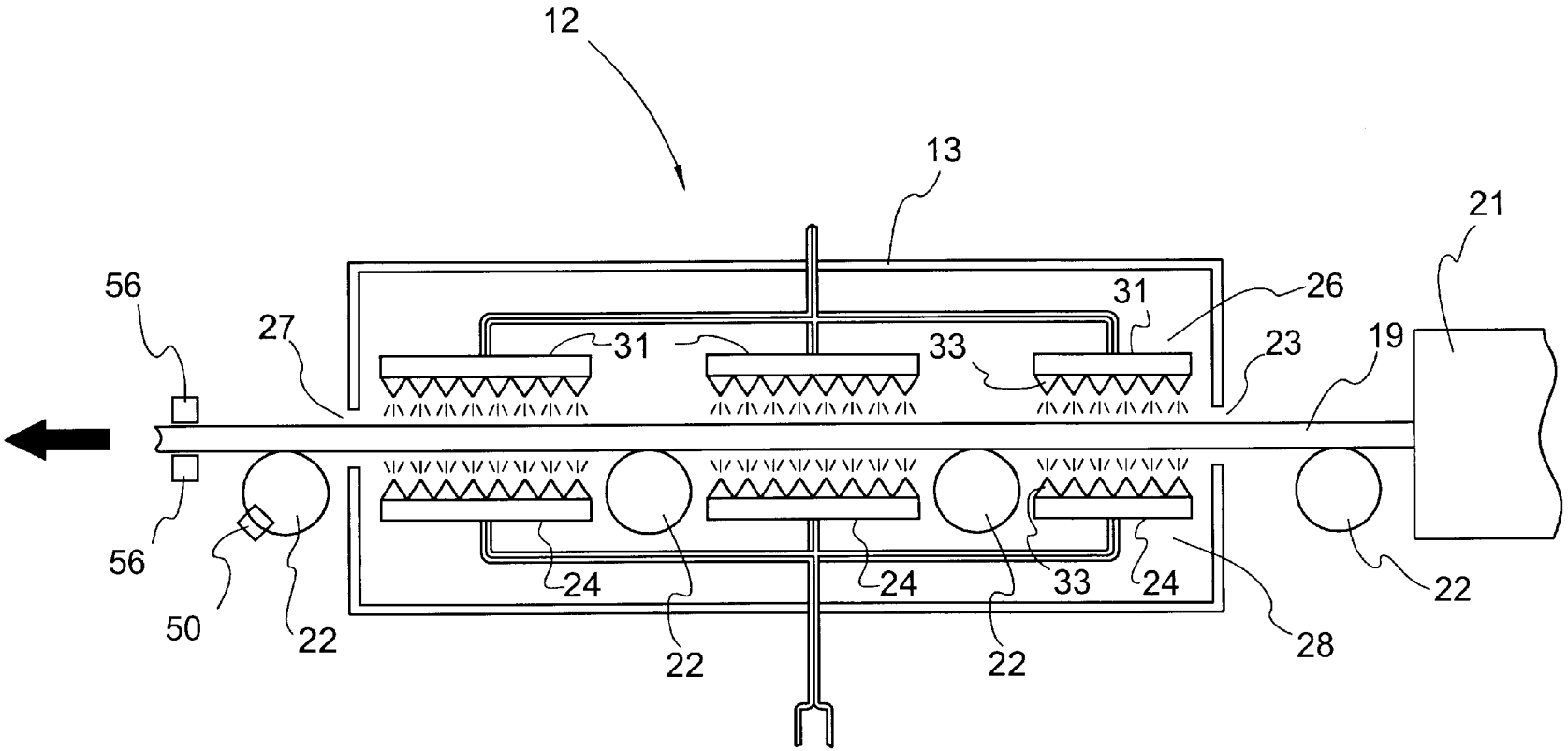
FIG. 2 is a schematic interior side elevation fragment view of an embodiment of the quench apparatus according to the invention.

Referring to FIG. 2, after exiting the caster assembly 21, the strand 19 is conveyed along the conveyor line at the caster speed by a plurality of spaced conveyor rolls (table rolls) 22 and is fed into the quench apparatus 12 through a quench apparatus entrance port 23. In this embodiment, the quench apparatus 12 is located immediately downstream of the caster assembly 21 and upstream of a strand severing apparatus 25 (FIG. 1). In the illustrated embodiment, the quench apparatus 12 has a housing 13 surrounding the strand 19 and confining the quench spray. The strand 19 after being quenched exits the housing 13 via exit port 27.

When the strand 19 is conveyed into the quench apparatus 12, selected portions of the strands are quenched by a plurality of intense sprays of water and air combined into an air mist applied by clusters of top spray nozzles 31 and bottom spray nozzles 24. (Air mist tends to be more efficient than water to quench steel.) As a result of the quench, the steel is rapidly cooled from its pre-quench start temperature to a suitable completion temperature so that the steel's microstructure is changed from austenite to one or more suitable microconstituents, such as ferrite or pearlite. It has been found that effecting a surface quench to a suitable depth, then reheating the steel in a reheat furnace 29 downstream of the severing apparatus 25, reduces or prevents altogether the occurrence of the surface defects in the steel product. Suitable transformed microstructures include pearlite, bainite, martensite and ferrite, or some combination of two or more of these. (Further downstream processing can result in an eventual preferred microstructure that is different from that obtained in the quench 12.) The preferred start temperature is at or above the steel's transformation start temperature $Ar_3$ and the suitable completion temperature is at or below the steel's transformation completion temperature $Ar_1$. It has been found that quenching from a start temperature below the transformation start temperature $Ar_3$ and above the transformation completion temperature $Ar_1$ is in some cases acceptable but not preferred, as quenching in this temperature range provides some but not as much reduction in the occurrence of surface defects as quenching from a temperature above the transformation start temperature $Ar_3$.

The steel transformation start and completion temperatures $Ar_3$, $Ar_1$ depend on the type of steel that is cast and the cooling rate. Most types of steel cast in a conventional continuous casting mill are suitable for application of the invention; for example, typical plain carbon steels suitable for quenching in accordance with the invention include steels having 0.03–0.2% carbon content. The cooling rate of a steel product is not constant throughout its body; cooling rates differ at different depths beneath the product surface. Different cooling rates will transform austenite to different combinations of transformation products; as the steel's cooling rate varies with strand depth, it follows that the transformed microstructure will differ with strand depth. It has been found that a minimum transformed depth of about ½ to ¾ inch will satisfactorily reduce the occurrence of surface defects.

The spray nozzle clusters 31, 24 are respectively arranged into a top array 26 and a bottom array 28, wherein each array 26, 28 applies cooling spray to an associated top and bottom surface of the strand 19. Each array 26, 28 is longitudinally aligned and has a series of longitudinal banks 26, 28 arrayed in parallel so as to provide spray coverage to the entirety of the top and bottom surfaces of a maximum-width strand 19.

The appropriate proportions of cooling fluid that should be applied respectively to the top and bottom surfaces so that both surfaces are quenched to the same depth can be empirically determined by removing test portions of the quenched strand and examining their cross-section. The appropriate proportion can then be programmed into the control system for the quench so that subsequently quenched portions of the strand will be quenched to the required depth.

Figure 3:
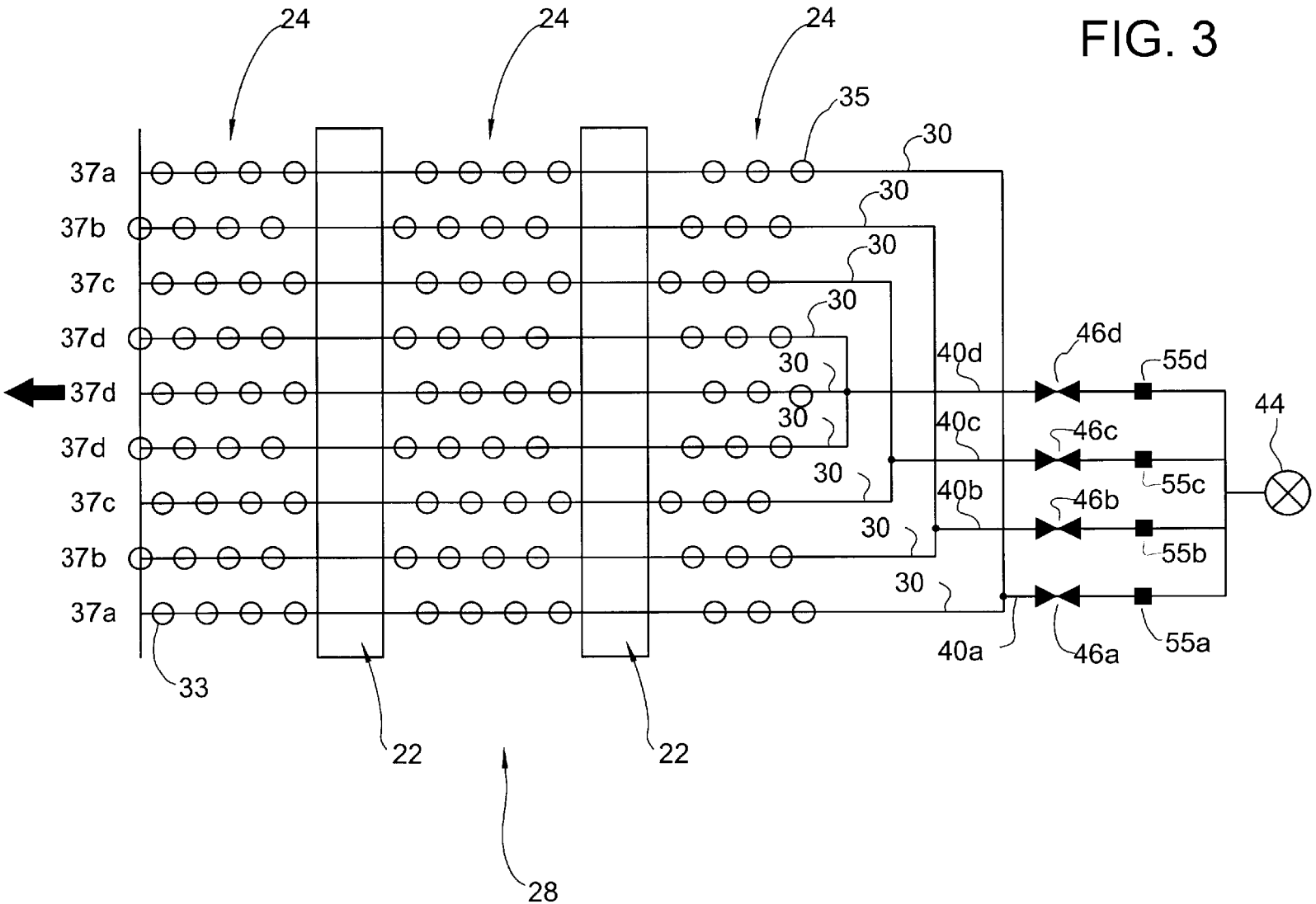
FIG. 3 is schematic plan view of an array of bottom transversely variable spray nozzles suitable for use with the quench apparatus of FIG. 2, and associated air and water supplies therefor.

Top and bottom nozzle clusters 24 are arranged in respective matrix arrays 26, 28 each comprising a plurality of equally spaced longitudinal banks 30 extending in columns parallel to the line. FIG. 3 illustrates this arrangement for bottom nozzle clusters 24; the mirror image of this arrangement would exist for top nozzle clusters 31 arranged in banks 26.

The number of banks 28 chosen to span the transverse width of the line depends on the maximum width of the cast strand. In the illustrated embodiment, there are nine banks of bottom nozzle clusters 24 by way of example.

The maximum number of nozzles 33 in a bank 30 depends on the interior length of the quench apparatus 12. In the embodiment illustrated in FIGS. 1–3, the length of the quench apparatus 12 is limited by the space available between the caster assembly 21 and the severing apparatus 25. An exemplary eleven nozzles 33 are arranged along the length of the quench apparatus 12 for each bank 30. Note that no nozzles 33 are arrayed so as to overlap the conveyor rolls 22; although the rolls 22 constitute a direct impediment to nozzle placement only for the bottom banks 28, the arrangement of the top banks 26 should mirror that of the bottom banks 28 to ensure spray symmetry so that uneven quenching of top and bottom surfaces of strand 19 is avoided or at least mitigated.

The bank of nozzles 30 are grouped into four groups 37*a*, 37*b*, 37*c*, 37*d*. Each group 37*a*, etc. comprises at least two banks 30 equidistant from the longitudinal center of the line. The center group 37*d* additionally includes one central bank 30 overlapping the center of the line. The spray applied to the strand 19 by any group 37*a*, etc. ("spray group") of nozzles 24 is controlled by controlling the flow rate and optionally other usefully controllable characteristics of the sprays (e.g., pressure) of the spray group 37*a*, etc. (such controllable characteristics are collectively referred to as "spray characteristics"). The spray characteristics of any one spray group 37*a*, etc. are controllable separately from the spray characteristics of other spray groups 37*b*, etc. as discussed in detail below. Each spray group 37*a*, 37*b*, 37*c*, 37*d* is supplied water from an associated respective water supply pipe 40*a*, 40*b*, 40*c*, 40*d* connected to and supplied by a water pump 44. Each nozzle 33 is provided with air from an air compressor 42 via suitable air supply lines (omitted from FIG. 3 for purpose of clarity). The air and water are mixed in each nozzle to provide the air mist applied to the strand 19.

Each water supply pipe 40*a*, 40*b*, 40*c*, 40*d* has an associated respective control valve 46*a*, 46*b*, 46*c*, 46*d*, the adjustment of which changes the water flow rate and consequently the air mist flow rate for each spray group 37*a*, 37*b*, 37*c*, 37*d*. Each such valve 46*a*, etc. may be a butterfly valve or any suitable adjustable flow-rate valve. Each water supply pipe 40*a*, 40*b*, 40*c*, 40*d* has an associated respective pressure regulator 55*a*, 55*b*, 55*c*, 55*d* the adjustment of which regulates the water pressure through the associated supply pipes 40. Similar air control valves and air pressure regulators control flow rate and pressure for the air (not shown). The air and water control valves 46 and pressure regulators 55 enable the spray characteristics of the sprays to be differentially controlled transversely across the strand 19. Since the temperature profile of the strand is almost always symmetrical about its centerline, the choice of spray groups 37*a*, etc. to include banks 28 equidistant from the center of the line is appropriate.

Preferably, each spray nozzle cluster 31, 24 comprises a longitudinally aligned series of individual nozzles 33 each being an internal-mix pneumatic atomizing-type nozzle that mixes water and air for discharging in a flat oval spray pattern. Each nozzle cluster 31, 24 is preferably positioned so that the major axis of the oval spray pattern is transversely oriented, i.e. perpendicular to the line. The transverse width of each spray pattern and the distance between adjacent clusters 24 of nozzles are selected so that there is no gap but preferably minimal overlap between the sprays of the adjacent clusters of nozzles. To this end, the nozzle clusters 24 in alternate columns are offset from one another by a selected amount.

Because slabs or slab-shaped strands tend to cool naturally more quickly around the vicinity of their outer edges than at other parts of the surface, and because air mist sprayed on the longitudinal central portions of the strand tend to migrate towards and contribute to further cooling of the outer edges, transverse differential spray control of the columns or longitudinally aligned banks 26, 28 enables a lower intensity of spray to be applied by the outer banks of nozzles 30 than the inner banks of nozzles 30. The spray characteristics of each spray group 37*a*, 37*b*, 37*c*, 37*d* can be selected in response to this expected temperature profile and the heat-transfer properties of the associated portion of the surface of the strand 19. Thus, by way of example, for quenching a given casting, spray group 37*a* might be idle, spray group 37*b* providing a low flow rate spray, spray group 37*d* providing a considerably higher flow rate spray, and spray group 37*c* providing a spray at a flow rate intermediate that provided by spray groups 37*b* and 37*d*. Suitable selection of flow rate and any other useful spray parameters enables the temperature of all surface portions of the strand 19 to be cooled to nearly the same post-quench temperature.

Masking means such as longitudinal flanges [not shown] can be optionally installed on both longitudinal strand edges to shield the outermost longitudinal edges of the strand from spray, thereby further reducing the amount of cooling effected on the strand edges. The longitudinal flange may be used in conjunction with the transversely controllable sprays to reduce the amount of edge cooling. Alternatively, suction means [not shown] such as longitudinal suction slots extending along the length of the quench apparatus 12 and at either longitudinal edge of the strand may be used suction excess cooling fluid collected on the top surface of the strand, thereby preventing overcooling of the edge portions of the strand.

It has been found that it is unnecessary to provide sprays especially to quench the sides of the strand (for a strand to be severed into slabs); the side surfaces tend to cool sufficiently quickly that separate spraying is unnecessary. Further, downstream edging may correct some surface defects in the vicinity of the side surfaces. If there is a risk of overcooling the side edges of the steel, shields or spray masks in the vicinity of the side edges may be optionally provided to impede cooling fluid from reaching the side edges of the steel.

The air compressor 42, the water pump 44 control valves 46 and pressure regulators 55 can be manually operated. An operator can determine the appropriate spray characteristics required to apply a suitable quench from temperature profile data of the incoming slab 19, then manually make the appropriate adjustments for each of these pieces of equipment. Preferably, at least some of these steps are automated by conventional means. In this connection and referring to FIG. 4, monitors or sensors for monitoring or measuring the values of selected parameters can be provided. For example, basic supply water pressure and air pressure, line speed, pre-quench surface temperature of the steel across a transverse profile, pre-quench surface temperature, post-quench surface temperature of the steel across a transverse profile, and spray group flow rates or valve settings could all be monitored or measured. The associated sensors are each electrically connected to and communicative with a control unit 60. For example, sensors 39, 41 for air and water supply respectively transmit data signals associated with air and water pressure respectively to the control unit 60 via data transmission lines 43, 45 respectively. The control unit in response to the received data signals can provide control signals via control signal lines 49, 51 to air pressure regulator 53 and water pressure regulator 55 respectively, to remedy any irregularity in the air and water supplies. Suitable intervening digital/analog converters, relays, solenoids, etc. are not illustrated but would be used as required in accordance with conventional practice. The specific means chosen for the sensing of system parameters and provision of data signals may be per se essentially conventional in character and is not per se part of the present invention.

Figure 4:
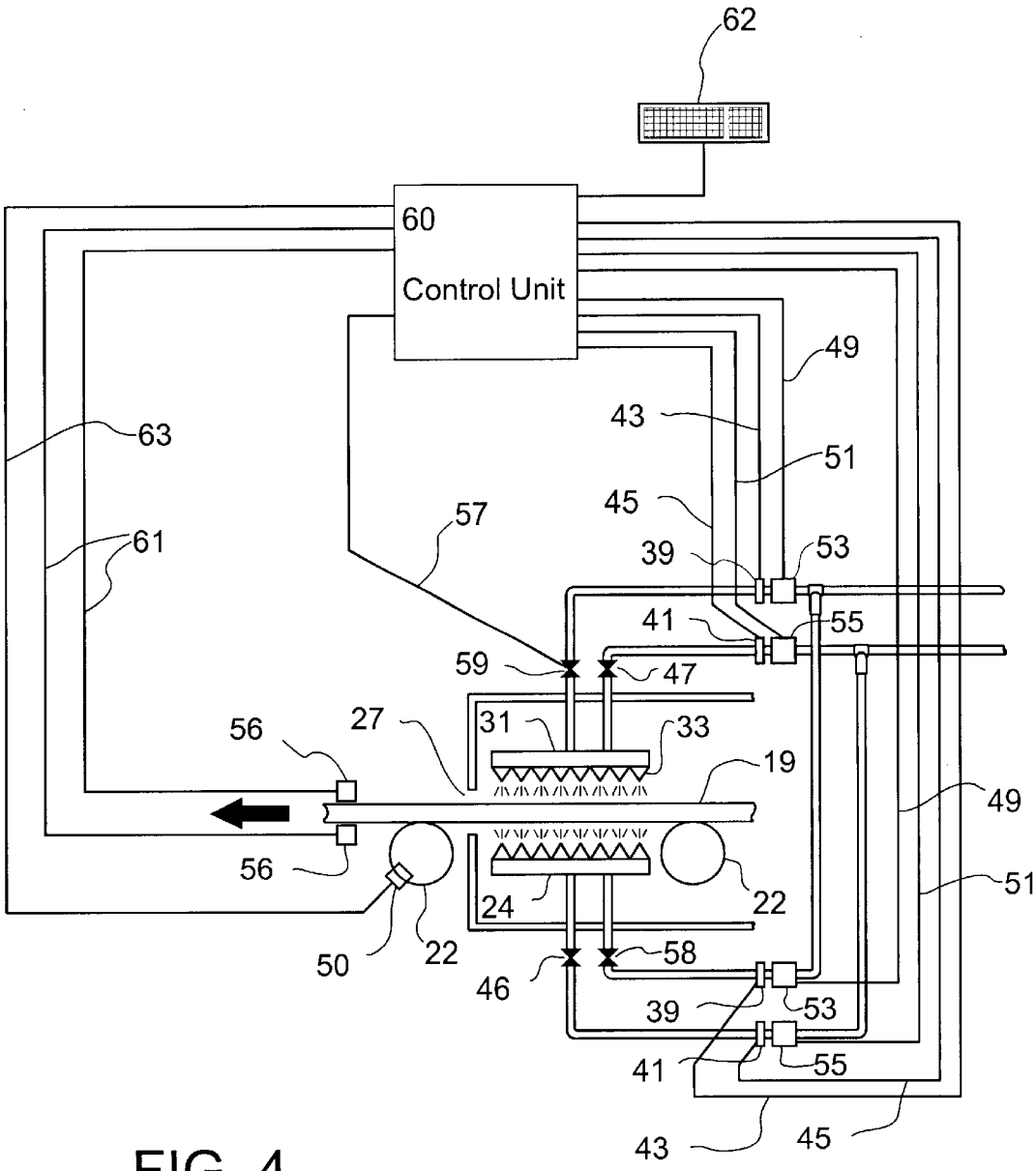
FIG. 4 is a schematic diagram of a control unit for the transmission of air and water to spray nozzles in the array of FIG. 3 shown as a fragmentary group.

Water control valves 46 and 47 control the water flow rate to bottom and top nozzle clusters 24, 31 respectively. Air control valves 58, 59 control the air flow rate to bottom and top nozzle clusters 24, 31 respectively. The air and water valves 46, 47, 58, 59 are similarly connected to and responsive to the control unit 60 which controls the flow rate of air mist through the valves 46, 47 by means of control signals transmitted via respective control signal lines, only one of which, line 57, is illustrated in FIG. 4 in the interest of simplification of the drawing.

Pyrometers 56 may be located downstream of the quench unit 12 or located in the vicinity of the quench unit exit port 27 or elsewhere as the designer may prefer, for example, pyrometers may be installed upstream of the quench unit 12. In FIG. 4, the strand 19 moves in the direction of the arrow (right to left). The pyrometers 56 illustrated are mounted downstream of the quench apparatus above and below the as-quenched strand 19 passing therebetween. While only one block 56 appears above and below the strand 19 in the drawing, it is to be understood that either the pyrometers 56 would be able to scan across the transverse width of the strand 19, or else a transverse array of pyrometers 56 across the width of the strand 19 would be provided. For each of the top and bottom strand surfaces, the pyrometers 56 measure the transverse temperature profile of the respective surface. The pyrometers 56 are electrically connected to and communicative with the control unit 60 and transmit data signals associated with the surface temperature to the control unit 60 via data transmission lines 61 following the stand's passage through the quench apparatus 12. With this data, the control unit 60 can determine whether the as-quenched temperature profile of the strand 19 falls within acceptable parameters; if not, the control program 60 (or the operator, if performed manually) calibrates the quench characteristics settings accordingly for the subsequent portions of the strand to be quenched. Generally, after enough data on castings of various compositions, widths, and casting histories have been accumulated, enough look-up tables for flow-rate settings will have been compiled that recalibration will seldom be necessary.

Roll speed tachometers 50 provide conveyor speed data to the control unit 60 via data line 63. One or more tachometers 50 are positioned at one or more selected conveyor rolls 22; in the case of quenching of slabs, such tachometers 50 may be preferably located at both upstream and downstream rolls 22 relative to the severing apparatus 25 so that a measurement of both casting speed and strand conveyor speed (if permitted to be different from casting speed) is obtained. However, for purposes of simplification, only downstream tachometer 50 is illustrated in FIG. 4. The conveyor speed data are used by the control unit 60 to determine the appropriate flow rate to be applied to the strand 19, as described in further detail below.

Similarly, the tachometer 50 may with the control unit 60 be part of a feedback control loop controlling the conveyor roll rotary speed. If line speed is to be made dependent upon quench operation, the conveyor roll drive (not shown) may receive control signals from the control unit 60 that control the rotary speed of the conveyor rolls 22. For example, the control unit 60 may be programmed to change the casting speed under certain circumstances, for example, if the casting speed exceeds the quenching capacity of the quench apparatus; in this situation, the control unit 60 would send a control signal to the caster assembly 21 to reduce the speed of the caster assembly 21.

In a preferred embodiment, the control unit 60 is a general purpose digital computer that is electrically connected to and receives data signals from sensed parameters, as exemplified by the various data signal lines from the devices illustrated in FIG. 4. The control unit 60 may have a memory storage device [not separately shown] for storing data, and is operated by a suitable control program. Programming the control program is routine and will take into account the specific objectives to be served in any given rolling mill; such programming is not considered to be per se part of this invention. For example, the control program may conveniently be based in part on conventional dynamic cooling control programs used in other parts of the casting mill, such as known cooling control programs used in the secondary cooling region of the strand containment and straightening apparatus 20.

Analysis indicates that preferred flow rate from a given nozzle, or bank or group of nozzles, is dependent upon casting speed roughly in accordance with the equation $$f=av^2+bv+c$$

where f is the flow rate for any given nozzle, or bank or group of nozzles, a, b and c are constants, and v is casting speed. Obviously the constants a, b, c will be different for a given individual nozzle, a given bank, or a given group. However, reliance should not be placed too highly on the analytical results; empirical approaches are required to determine optimum flow rate choices for nozzle groups.

Because the equation given above for the relationship between flow rate and casting speed includes one term that is proportional to the square of the casting speed, it follows that dramatically increasing flow rates are required as casting speed increases. For example, the flow rate at a casting speed of 60 inches per minute for a 6-inch casting might be roughly three times the flow rate required for the same casting travelling at 30 inches per minute.

The control unit 60 may have user input devices such as a keyboard 62 to enable an operator to input new data or override any of the functions performed by the control program. For example, a test slab may be occasionally removed from the casting line after the strand from which it was cut was quenched and before it enters the reheat furnace. The cross-section of the test slab is then examined to determine (a) whether the steel's microstructure has been transformed by the quench to a suitable depth, and (b) whether the depth is suitably uniform across the transverse width of the slab. If the operator is not satisfied with the quench effected on the test slab, he may reprogram, adjust the weight to be given the parameters used by the quench program, recalibrate and recalculate look-up tables, or manually select the spray characteristics and any other controllable parameters, so that subsequent steel product is quenched to his satisfaction.

Referring back to FIG. 1, after the strand 19 has been quenched by the sprays of the quench apparatus 12, the strand 19 exits the quench apparatus 12 and is severed into slabs by the severing apparatus 25. The slabs are then conveyed into the reheat furnace 29, where the quenched portions of the slab are reheated to a temperature at least or above the steel's transformation start temperature $Ac_3$, thereby re-transforming the transformed microstructure into austenite. In practice, the slabs are heated beyond the $Ac_3$ and above $T_{nr}$, to provide a suitable temperature for controlled downstream rolling. It has been found that the austenite formed by this combination of quenching and reheating tends to have a finer grain size than austenite grains of a steel product that has not been quenched before reheating. It has further been found that formation of finer grains of austenite is associated with the reduction in the occurrence of defects in the surface of the eventual steel product.

Referring to FIGS. 3 and 4, the transverse differential control of the spray nozzles 24 enables the control unit 60 to tailor the transverse width of the sprays to the width of the target strand 19 and to adjust flow rates of the spray groups 37*a,* etc. to fit the surface temperature profile of the strand 19. The control unit 60 receives and processes a data signal identifying the width of the strand, determines the number of spray groups that are required to cover the target surfaces, and sends control signals to the appropriate output control devices (e.g., solenoid valve actuators for the control valves) that will enable or disable the spray groups 37*a,* etc. and adjust their respective flow rates.

After quenching, the product is passed into a reheat furnace, where it is heated to a temperature suitable for subsequent downstream processing. In the reheat furnace, each quenched surface layer is reheated to a temperature above the $Ac_3$ and re-transformed to finer grains of austenite, thereby reducing the occurrence of surface defects on the eventual steel plate product.

The foregoing description has covered steady-state conditions in which the casting speed is constant. However, casting speeds typically vary considerably throughout a casting run. Since whenever the speed begins to change, it is uncertain what new steady-state value of casting speed will be reached, the flow-rate control system has to respond on the basis of an inherent uncertainty as to the new target casting speed expected to be reached after the current transient condition has come to an end. It has been found that potential deceleration-related over-quench problems tend to be more acute than potential acceleration-related under-quench problems, partly because casting-line problems tend to require a fairly steep "ramp down" deceleration that is sometimes as much as three times the rate of "ramp up" acceleration. Accordingly, the requisite decrease in flow rate to avoid over-quenching should be greater when deceleration occurs than the increase in flow rate when acceleration occurs in the casting line. In any given facility, an empirical approach should be taken to determine the optimum value. Monitoring surface temperature of the steel downstream of the quench may facilitate automatic or operator control of the flow rate through the quench nozzles. Typically the downstream surface temperature should be maintained in the range about 532° C. (1000° F.) to about 704° C. (1300° F.).

Figure 5:
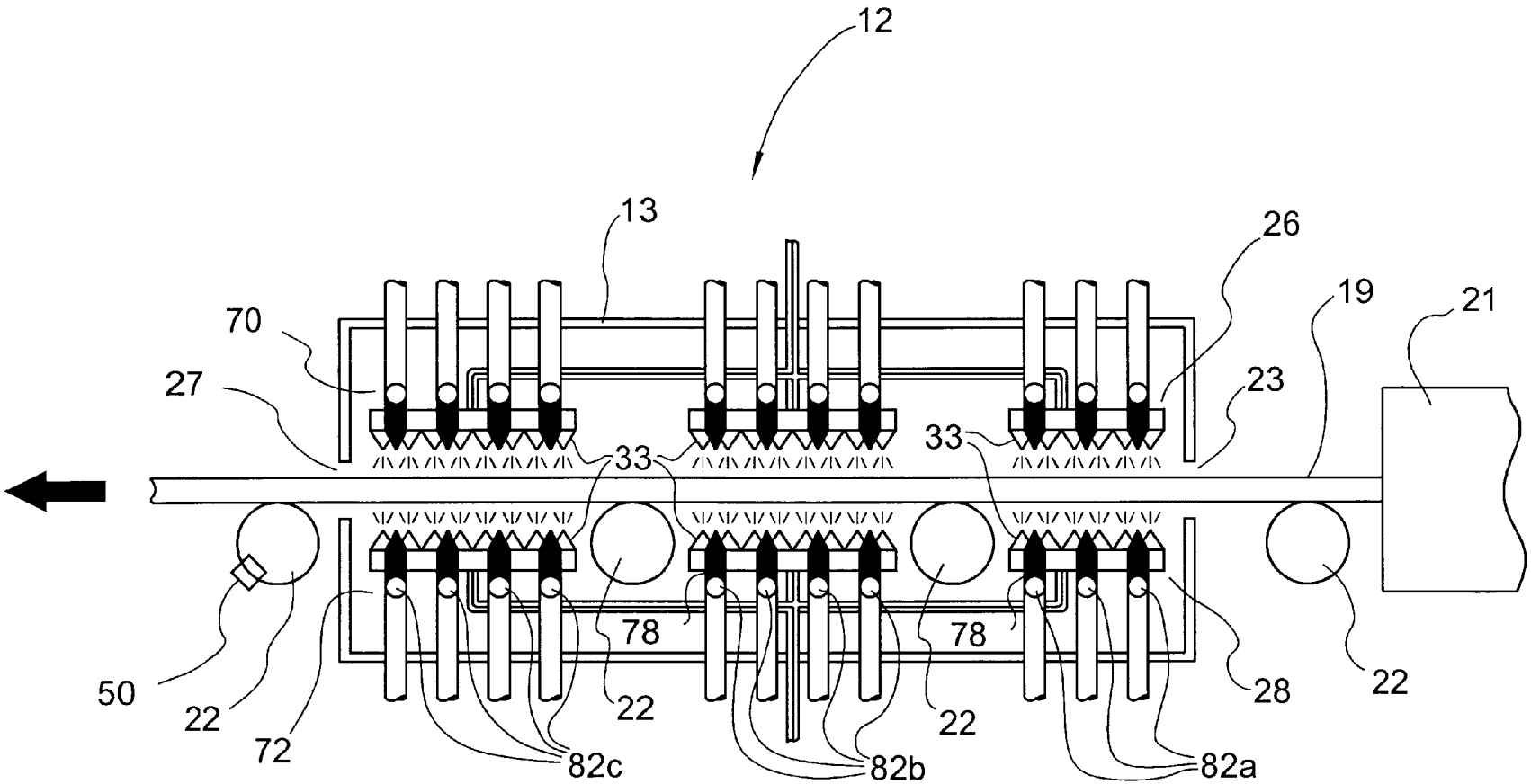
FIG. 5 is schematic interior elevation view of top and bottom groups of spray nozzles within a quench apparatus according to an embodiment of the invention that provides both transverse and longitudinal adjustment of flow rate of cooling fluid from the nozzles.
Figure 6:
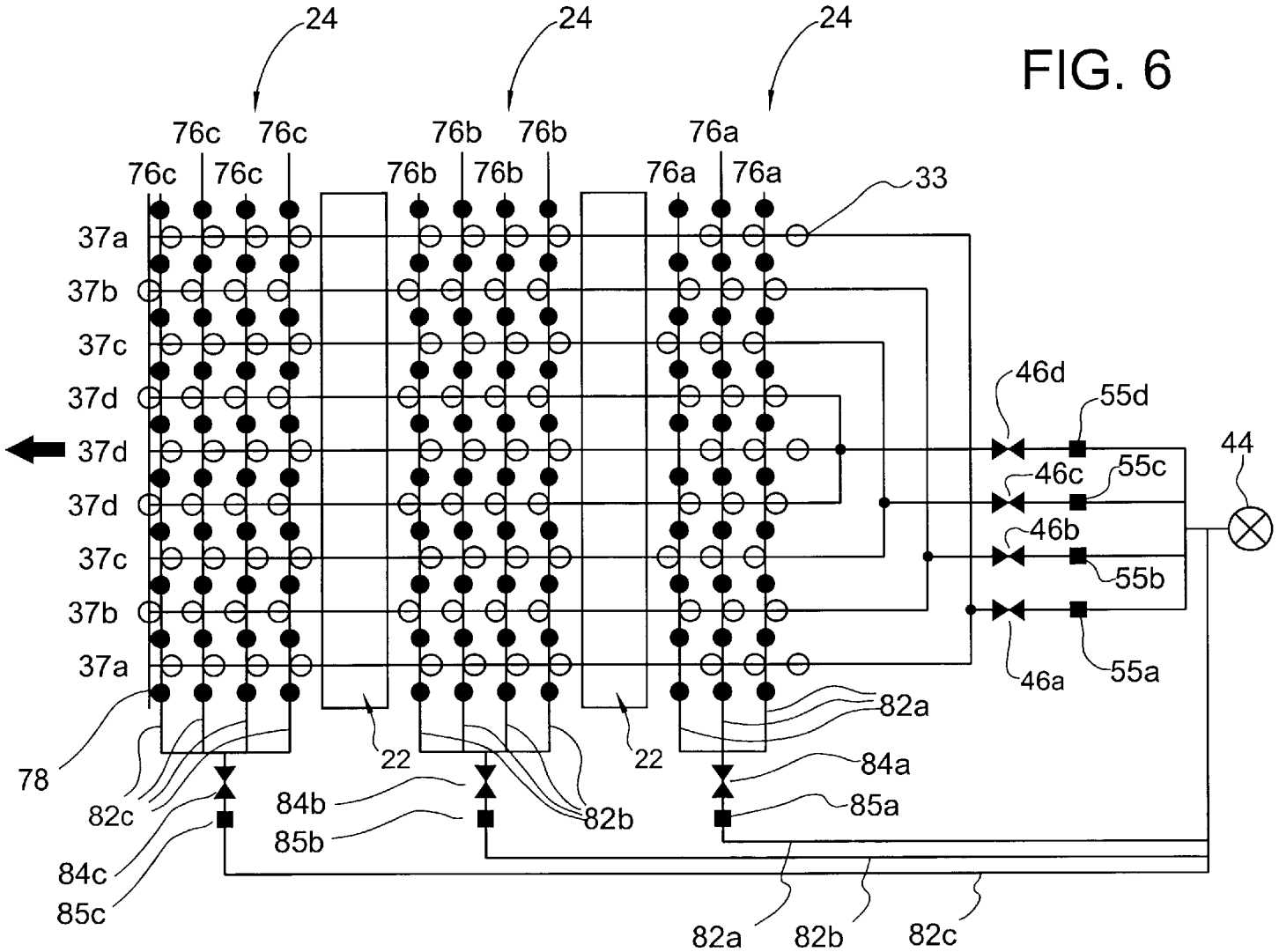
FIG. 6 is schematic plan view of an array of longitudinally adjustable nozzles and transversely adjustable nozzles and supply lines therefor, for use within a quench apparatus according to an embodiment of the invention that provides both transverse and longitudinal adjustment of flow rate of cooling fluid from the nozzles.

FIGS. 5 and 6 illustrate an alternative embodiment of the quench apparatus 12 that includes longitudinal spray control. In this embodiment, there is a second top and bottom arrays of nozzle clusters 70, 72 interspersed with the top and bottom nozzle arrays 26, 28 of the first embodiment, i.e. the array of nozzles that are actuated on a transversely variable basis. For purposes of distinction, the second top and bottom arrays are hereinafter referred to as the longitudinal-control arrays, and the arrays of the first embodiment illustrated in FIGS. 1–4 are referred to as the transverse-control arrays.

The longitudinal-control arrays are actuated on a longitudinally variable basis. To this end, there are opposed top and bottom longitudinal-control arrays of nozzles 70, 72 (FIG. 5) above and below the strand 19, respectively. For convenience, the bottom longitudinal-control array 72 is discussed, it being understood that the discussion also applies to the top longitudinal-control array 70. The longitudinal-control array 72 comprises a plurality of separate longitudinally-spaced banks 76*a,* 76*b,* 76*c* of transversely aligned nozzles ("longitudinal nozzle banks") each having dedicated supply pipes 82*a,* 82*b,* 82*c* that are arranged in a horizontal plane below the bottom transverse-control array 28. Each nozzle 78 of each longitudinal nozzle bank extends from its respective supply pipe 82*a* etc. into the same plane as the nozzles 33 from the bottom transverse control array 28. Each longitudinal nozzle bank 76 spans a width that is at least as wide as the maximum strand width. The nozzles 78 provide spray patterns complementary to the spray patterns provided by the transverse-control nozzle array 28. The arrangement illustrated is exemplary; more longitudinal-control nozzle banks could be provided; more nozzles altogether of smaller capacity and providing smaller spray patterns could be provided, etc.

In this embodiment, the longitudinal supply pipes 82 are connected to associated respective water control valves 84*a,* 84*b,* 84*c* and water pressure regulators 85*a,* 85*b,* 85*c*. Similarly, the longitudinal supply pipes are connected to associated respective air control valves and pressure regulators (not shown FIG. 5) In a manner similar to the transverse spray control described in the first embodiment, the control valves 84 and pressure regulators 85 regulate the fluid flow rate and pressure for the three longitudinally spaced banks 76. Such longitudinal control is useful in countering non-uniform longitudinal cooling in the strand, which may for example, be caused by anomalies in the orderly progress of the steel through the caster assembly 21. For example, for a given length of the strand, the leading portion may be at a higher temperature than the trailing portion at a given line location. In this connection, the longitudinal-control array may be programmed to apply a higher intensity quench to the leading portion of the strand, and a lower intensity quench to the trailing portion. As the lengthwise strand portions are moving through the quench apparatus 12, the quench intensity for each longitudinally spaced group must be varied depending on which strand portion is directly above (or below for the top longitudinal array 70).

Optionally, the flow rate provided by each longitudinal array nozzle 78 near the center line of the strand may be somewhat larger than that of nozzles 78 near the strand edges. Suitable sizing of the nozzles 78 in the banks 76 can achieve this objective. This variation in flow rate across the bank enables a higher coolant flow rate to be provided by the central nozzles 78 than the outermost nozzles 78, thereby providing a differential transverse cooling to complement the variable control transverse cooling described in the first embodiment, albeit without fine transverse control of the longitudinal-control nozzles. The chosen transverse flow-rate profile would be selected to match within engineering limits the transverse surface temperature profile of an average casting.

The quench apparatus 12 in accordance with this embodiment may be alternatively located downstream of the severing apparatus 25. The steel product that enters the quench apparatus 12 will in such case typically be in the form of slabs severed by the severing apparatus 25. The data and control program parameters of the control unit are appropriately modified to account for the longer distance between the caster assembly 21 exit and the quench apparatus entrance 23, and the time it takes the strand to travel this distance. Locating the quench apparatus 12 further downstream from the caster assembly 21 enables the steel product to cool somewhat in ambient air before it reaches the quench apparatus 12, thereby reducing the amount of water and energy required to quench the product surfaces to the appropriate temperature.

If the quench apparatus is located downstream of the severing apparatus 12, the casting line speed should preferably be kept constant between the caster assembly 21 and reheat furnace 29. As the steel product has been severed into slabs, the casting line speed of the slabs can be changed relative to the casting line speed for the strand. However, when such a speed change occurs, slabs tend to develop a longitudinal temperature gradient. For example, if the speed of the casting line downstream of the severing apparatus increases, the steel product that has exited the caster assembly 21 but not yet entered the quench apparatus 12 will have a downstream portion that will have had more time to cool than an upstream portion. In a typical continuous casting mill, the casting line speed remains fairly constant between the caster assembly 21 and the reheat furnace 29, and therefore, the occurrence of such longitudinal temperature gradients is minimal. However, should there be a longitudinal temperature gradient, such gradient can be minimized or eliminated by use of the longitudinal spray control described above.

The arrangement offering the finest differential control over the spray characteristics of the sprays would include an array of nozzles having a dedicated supply line and control valve for each nozzle. This arrangement is within the scope of the invention but is not preferred, as the high number of individual controls may make the cost of constructing a quench apparatus prohibitive and the control system for the array unduly complex.

The quench apparatus 12 may quench slabs that include titanium as an alloying element. In such cases, the relative position of the quench apparatus 12 in the line, its longitudinal dimensions, and the speed of the casting or slab are preferably optimized to permit substantial TiN precipitation so that AlN precipitation is suppressed and solute nitrogen content is reduced. The presence of solute nitrogen tends to reduce ductility in the cast metal. Typically, the metal contains between about 0.015% and 0.040% titanium. Preferably, enough titanium is added to the metal prior to quenching to form a titanium-to-nitrogen weight ratio of the order of 3:1. Quenching to a post-quench surface temperature below about 750° C. to 800° C. yields optimal TiN precipitation, thereby optimally suppressing AlN formation. As a further effect of optimal TiN precipitation, solute nitrogen content is reduced. As a result, undesirable effects caused by AlN precipitation are minimized. Other residual elements may precipitate and/or segregate to grain boundaries as the strand cools prior to being quenched. Any contribution to hot shortness by the other residual elements appears to be addressed either by the quench alone, or by some combination of the quench and TiN precipitation. Also, the decrease in ductility resulting from residual element precipitation is at least partially offset by the increase in ductility from the solute nitrogen reduction.

In a further alternative embodiment, a portion of the quench apparatus 12 is installed within the strand containment and straightening apparatus 20 near the caster assembly exit, and operates in conjunction with a portion of the quench apparatus 12 positioned outside the caster assembly 21 to quench the steel product in a manner described for the above two embodiments. Of course, the strand 19 must be completely unbent and straightened before it is quenched.

EXAMPLE

Consider a steel casting about 6 inches thick, and of variable width of anywhere between about 40 inches and 125 inches, being produced at normal casting line speeds of anywhere between about 30 inches per minute and 75 inches per minute. Assume that a quench penetration of at least about a half-inch from the surface is targeted, and that the quench will reduce surface temperature of the casting from a temperature of the order of (982° C.) 1800° F. to a temperature of the order of 538–704° C. (1000–1300° F.).

Engineering considerations, notably the principle of simplification, make it desirable to control nozzles in banks of longitudinally aligned nozzles. Four groups of top nozzle banks can be arrayed over the maximum width of the casting, including:

first, a central group of at least 1, and perhaps 3 or 5 banks of nozzles;

second, a mid-inner group comprising, say, 4 banks of nozzles, two on either side of the centre line and lying outside the central group;

third, a mid-outer group of nozzles comprising, say, 4 nozzle banks, two on either side of the centre line and outside the mid-inner group; and fourth, a final outermost group of nozzles comprising, say, 4 banks, two on either side of the centre line, and the outermost bank of which on each side of the centre line overlaps the edge margin of the casting of maximum width, or may be inset slightly from the edge of the casting;

A counterpart four groups of bottom nozzle banks can be arrayed under the casting in a comparable manner. Note that the maximum number of nozzle banks in the foregoing example exceeds the number illustrated in FIG. 3.

With a nozzle array and nozzle bank selection of the foregoing sort, it may be useful to operate all four groups of top and bottom nozzles only when the casting being produced is of maximum width, or up to about, say, 90% of maximum width. For castings of, say, 75–90% of maximum width, the outermost group of nozzles would be idled. For castings of about 55–75% of maximum width, the outermost group and the mid-outer group of nozzles could be idled. For castings of about 35–55% of maximum width, all nozzle groups except the central group could be idled.

Conveniently, the bottom nozzles underneath the casting may correspond on a one-to-one basis with the top nozzles above the casting. The groups of bottom nozzles can operate at flow rates that may conveniently be set at a specified multiple of the flow rates of the corresponding groups of top nozzles. It has been found that the flow rate for the bottom nozzles should be preferably from about 1.2 to about 1.5 times the flow rate for the top nozzles located above the casting. The reason for the difference, of course, is that water or other cooling fluid is assisted by gravity to cool the top of the casting, but water quickly falls away from the bottom surface of the casting.

It may be desired to set the flow rates for the different groups of nozzles at specified fractions of the central group. The fraction chosen will depend upon how many groups there are altogether, and whether particular groups are operating, or idle. It has been found effective to have the outermost nozzle groups provide flow rates that can be as little as about ¼ the flow rate of the central nozzle group, with the fractions for nozzle groups between the outermost group and the central group progressively increasing in relative flow rate as one progresses from the transverse edge of the nozzle array toward the central nozzle group (which coincides with the central portion of the casting being sprayed). For example, the mid-inner nozzle group next to the central group might be operated at about 50 to 75% of the flow rate of the central group of nozzles. Different ratios may be chosen for the top and bottom arrays of nozzles respectively, but generally similar ratios have in practice proven to be satisfactory for a given top nozzle group and its counterpart underneath the casting, relative to the central nozzle group in the two cases.

It has also been found that if nozzle groups are selected as indicated above, and idled selectively as indicated above, it may be possible to have all three nozzle groups other than the central nozzle group operate at a single specified fraction of the flow rate of the central nozzle group, the fraction preferably being in the range about 50–75% of the flow rate provided by the central nozzle group. Transverse control of flow rate in this mode of operation is effected by selectively idling one or more groups of nozzles.

There is a minimum flow rate through the nozzles where the spray pattern cannot maintain its integrity. As the flow rate selected for each nozzle depends on the product speed through the quench unit 12, the product speed must not be such where the spray pattern integrity is compromised. Smaller nozzles tend to maintain spray pattern integrity for lower flow rates that larger nozzles; in this connection, such smaller nozzles may be installed for surface portions the require less cooling, e.g. the outermost product edges.

Values chosen for flow rates, selection of nozzle groups to remain idle, and other operating parameters may be expected to vary depending upon steel grade. For most commercial grades of steel plate cast from a 6" mold, a quench penetration into the casting of about ½" is satisfactory. The total flow required will vary considerably with casting width; for narrower castings of up to about 65", it may be possible to achieve quite satisfactory quenching with only the central nozzle groups (top and bottom) operating. For maximum-width castings of, say, 125", all nozzle groups should operate for at least moderate casting line speeds (say 30"/min and over). At a casting line speed of 30"/min, the top central nozzle group of three longitudinal banks of nozzles might provide a flow rate of about 120 gal/min; at 60"/min, that same group might provide a flow rate of about three times the flow rate set for 30"/min. The actual choices of setting of flow rate per nozzle group are best determined empirically for each speed, for each casting width, and for each grade of steel being produced. A set of look-up tables may be compiled based on the empirical data and used as input to the computer for controlling nozzle groups or used by the mill operator to set flow rates, or in unusual or experimental circumstances to override the computer where this is considered desirable. Computer control of solenoids or relays or the like for controlling butterfly valves or other suitable valves for individual nozzles or groups of nozzles is known per se and not per se part of the present invention. If desired, appropriate instrumentation, such as pyrometers, may be located at the quench unit 12 entrance and used to construct a temperature profile model of the incoming steel product. This model would be updatable with fresh date from the instrumentation and would be utilized by the control unit 60 to dynamically control the operation of the quench.

For automatic control of the quench, the quench control program may be alternatively developed from known cooling control models, such as those developed by Richard A. Hardin and Christoph Beckermann from the University of Iowa, or. I. V. Samarasekera et al. from the University of British Columbia. The programming of the control program from such known control models or known cooling control programs is routine.

Other alternatives and variants of the above described methods and apparatus suitable for practising the methods will occur to those skilled in the technology. For example, instead of having all nozzles of the same size, higher-capacity nozzles could be used for quenching the inner surface areas of the steel, and lower-capacity nozzles could be used for quenching the outer surface areas of the steel. The scope of the invention is as defined in the following claims.

What is claimed is:

1. In or for use in a continuous casting steel mill having a caster for producing steel castings, severing means downstream of the caster for transversely severing castings emanating from the caster, a reheat furnace downstream of the severing means, and a conveyor for conveying castings from the caster to the reheat furnace;

quench apparatus located in-line downstream of the caster and upstream of the reheat furnace for quenching a surface layer of the casting to a selected depth of penetration so as to transform austenite in the surface of the casting to a non-austenitic microstructure, said quench apparatus comprising:

(a) an array of spray nozzles arranged in transversely separated groups above and below castings passing therebetween;

(b) at least one valve for each group for controlling the amount of spray provided by each group to the castings passing therebetween;

(c) a control unit for controlling the valves thereby to regulate the amount of spray provided by each group, in response to selected parameters including casting width and casting speed;

thereby to provide transversely differentiated spray to the castings being quenched.

2. Quench apparatus as defined in claim 1, wherein the selected parameters include post-quench surface temperature of the casting.

3. Quench apparatus as defined in claim 2, located upstream of the severing means.

4. Quench apparatus as defined in claim 2, located downstream of the severing means.

5. Quench apparatus as defined in claim 2, wherein the array of nozzles underneath the casting is substantially the mirror image of the array of nozzles above the casting.

6. Quench apparatus as defined in claim 5, wherein the nozzles are operable to apply air-mist to the castings.

7. Quench apparatus as defined in claim 5, additionally including suction means above the casting for removing surplus fluid.

8. Quench apparatus as defined in claim 5, wherein the array of nozzles underneath the castings is operable to provide a greater amount of spray to the castings relative to the spray provided by the nozzles above the castings.

9. Quench apparatus as defined in claim 5, additionally including spray nozzles arrayed in longitudinally speed transversely extending groups, said last mentioned groups being controlled by the control unit to provide a longitudinally differentiated spraying of castings.

* * * * *

UNITED STATES PATENT AND TRADEMARK OFFICE

CERTIFICATE OF CORRECTION

PATENT NO. : 6,374,901 B1 
DATED : April 23, 2002
INVENTOR(S) : William R. Frank, Jonathan Dorricott, Laurie E. Collins, Joseph D. Russo, Robert J. Boecker and Brian H. Wales It is certified that error appears in the above-identified patent and that said Letters Patent is hereby corrected as shown below:

Column 5,
Line 65, "21" should be deleted.

Column 6,
Line 14, "group" should read -- quench --; and
Line 28, "into" should read -- the --.

Column 11,
Line 29, "used suction" should read -- used to suction --.

Column 18,
Line 22, "that" should read -- than --;
Line 23, "the" should read -- that --; and
Line 55, "date" should read -- data --.

Column 20,
Line 25, "speed" should read -- spaced --.

Signed and Sealed this

Fourteenth Day of January, 2003

JAMES E. ROGAN
*Director of the United States Patent and Trademark Office*